US005769473A

United States Patent [19]

Sovis

[11] Patent Number: 5,769,473

[45] Date of Patent: Jun. 23, 1998

[54] APPARATUS FOR DOOR RESTRAINING ASSEMBLY

[76] Inventor: Martin Sovis, 5279 Duffield Rd., Flushing, Mich. 48433

[21] Appl. No.: 855,747

[22] Filed: May 8, 1997

Related U.S. Application Data

[63] Continuation of Ser. No. 572,684, Dec. 14, 1995, abandoned.

[51] Int. Cl.[6] ..... E05B 15/02

[52] U.S. Cl. ..... 292/340; 292/DIG. 17; 292/DIG. 53; 408/72 R

[58] Field of Search ..... 292/340, 341.11, 292/341.12, 341.18, 194, 40, 36, 35, 33, 346, 300, DIG. 17, 383, DIG. 53; 144/27, 93.1; 33/562, 97, 666, 667; 408/241 G, 72 R; 49/383

[56] References Cited

U.S. PATENT DOCUMENTS

| | | | |
|---|---|---|---|
| D. 374,724 | 10/1996 | Berna | D25/48 |
| 982,396 | 1/1911 | Swift . | |
| 1,421,746 | 7/1922 | Thorne . | |
| 1,635,920 | 7/1927 | Belvin | 292/300 |
| 1,853,456 | 4/1932 | Ross | 292/340 |
| 2,353,295 | 7/1944 | Day | 408/72 B |
| 2,571,633 | 10/1951 | Vogel . | |
| 2,797,432 | 7/1957 | Gakle . | |
| 2,937,898 | 5/1960 | Russell | 292/340 |
| 3,089,720 | 5/1963 | Schlage | 292/2 |
| 3,113,600 | 12/1963 | Hillgren | 408/72 R |
| 3,636,659 | 1/1972 | Bylicki | 292/DIG. 17 X |
| 3,937,506 | 2/1976 | Dean | 292/300 |
| 3,969,788 | 7/1976 | McCullough . | |
| 3,970,340 | 7/1976 | Taft | 292/DIG. 17 X |
| 3,971,100 | 7/1976 | Anop . | |
| 4,005,890 | 2/1977 | Murch | 292/340 |
| 4,065,162 | 12/1977 | Schlage | 292/340 |
| 4,085,650 | 4/1978 | Flynn . | |
| 4,186,954 | 2/1980 | Detlefs | 292/340 |
| 4,189,175 | 2/1980 | Paxton | 292/340 |
| 4,211,442 | 7/1980 | Hansen | 292/340 |
| 4,243,256 | 1/1981 | Frydrych | 292/245 |
| 4,288,944 | 9/1981 | Donovan | 292/40 |
| 4,435,921 | 3/1984 | Marin | 292/33 |
| 4,550,939 | 11/1985 | Babb, Jr. et al. | 292/340 |
| 4,629,231 | 12/1986 | Bouchard | 292/340 |
| 4,640,052 | 2/1987 | Zebedee et al. | 292/DIG. 17 X |
| 4,823,510 | 4/1989 | Amos | 292/DIG. 17 X |
| 4,832,386 | 5/1989 | Sweet | 292/340 |
| 5,116,170 | 5/1992 | Palmer et al. | 408/72 B |
| 5,154,461 | 10/1992 | Prescott et al. | 292/340 |
| 5,570,917 | 11/1996 | Cutrer | 292/346 |

FOREIGN PATENT DOCUMENTS

| | | | |
|---|---|---|---|
| 939835 | 11/1948 | France | 49/383 |
| 2727818 | 1/1979 | Germany | 49/383 |
| 1072632 | 6/1967 | United Kingdom | 49/383 |
| 1424827 | 2/1976 | United Kingdom | 292/346 |
| 2139690 | 11/1984 | United Kingdom | 292/145 |

*Primary Examiner*—Rodney M. Lindsey
*Attorney, Agent, or Firm*—Gifford, Krass, Groh, Sprinkle, Patmore, Anderson & Citkowski, P.C.

[57] ABSTRACT

A door restraining assembly for use with a door hingedly connected to a surrounding door frame. At least one pin member includes a cylindrically shaped body and is positioned within a recess drilled into either or both a hinge side and door side of a door. A seating portion extends laterally from the pin member past the door surface. At least one receiving member includes a pin receiving portion and a reduced diameter reinforcing portion and is mounted within a corresponding recess drilled within the door jamb. The recess for the reinforcing portion extends well past the door jamb and through one or more of the vertically extending wall studs of the wall structure surrounding the door frame. According to further embodiments, a restraining assembly is provided on each the hinge side and latch side of the door frame. A method for installing a restraining assembly according to the present invention is also disclosed.

10 Claims, 3 Drawing Sheets

APPARATUS FOR DOOR RESTRAINING ASSEMBLY

This is a continuation of application Ser. No. 08/572,684 filed on Dec. 14, 1995 now abandoned.

BACKGROUND OF THE INVENTION

1. Field of the Invention

The present invention relates generally to door locking devices and, more particularly, to an improved door restraining assembly and method of installation having a pin member secured to and projecting from an edge of a door and a receiving member within which the pin member seats when the door is rotated to a closed position, the receiving member being recessed within a corresponding edge of a door jamb and contacting a wall stud of a wall structure surrounding the door jamb.

2. Description of the Prior Art

Locking devices and assemblies for use with doors are constantly being developed and improved in an attempt to counter the ever increasing threat and incidence of break ins and burglaries. The objective of such devices and assemblies is always the same, to protect the homeowner or business owner's person and property by keeping out unauthorized individuals.

The most basic types of door locking structure include the door knob key lock and the dead bolt assembly. In each case, a key is usually required to withdraw a latch member of the locking device from within a recess or cavity within the associated door jamb to enable the door to be rotated to an open position. While certainly providing a good measure of protection, burglars have still been able to find ways to overcome such conventional locking devices. It has been found that the most basic way of overcoming conventional locking assemblies, aside from picking the locks, is to simply apply an adequate level of force to the door to overcome the holding forces between the latch portion and the jamb recess or cavity. This is usually accomplished simply by kicking the door open. The door can also usually be opened by from the hinge side in the same manner by applying adequate force to the hinge plates to cause them to separate from the hinge screws embedded within the hinge side door jamb.

U.S. Pat. No. 3,970,340, issued to Taft, teaches a hinge pin lock assembly which is intended to complement a conventional key lock assembly and which includes a pin member having a shaft and an enlarged head and a substantially hat-shaped sleeve member having a cavity shaped interior. The shaft of the pin member is driven into a side of the door jamb so that the head projects laterally in a direction towards the door opening. A recess is formed in the corresponding position of the door jamb and the sleeve member is recess mounted within the jamb such that, when the door is pivoted to the closed position, the head portion of the pin seats automatically within the sleeve member.

According to the teachings of the Taft, the objective of the hinge pin lock is to prevent a would be burglar from removing the hinge pins on an outwardly opening door and utilizing a crowbar or like tool to pry open the door from the hinge side. The disadvantage of Taft is that it does not provide an adequate measure of protection against an burglar who attempts to forcibly kick open the door. This is so because the portion of the door jamb or trim within which the sleeve member is seated is easily separated along with the door hinge plates from the doorway in response to an applied force.

U.S. Pat. No. 3,969,788, issued to McCullough, teaches a door lock hinge having first and second hingedly connected plate members, the first plate member being connected to an inside frame or jamb of a door opening and the second plate member rotated to a right angle position relative to the first plate member when the door is closed. A bolt is slidably mounted to the second plate member and, when the plates are in their proper alignment, is slided in a normal direction into a receiving bore in a hinge shaft between the plates to lock the plates together in right angle relationship.

As with Taft, the shortcoming of a locking device such as that taught by McCullough is that it provides only a limited amount of restraining support and would be easily overcome by a burglar capable of generating enough physical force to overcome the locking device. McCullough is also distinguishable in that the door lock hinge is mounted to the door knob side of the door as opposed to Taft which is mounted to the hinge side.

SUMMARY OF THE PRESENT INVENTION

The present invention is a restraining assembly for use with a door hingedly connected to a surrounding door jamb which prevents a potential burglar from forcibly dislodging the door from the jamb. A pin member is provided and includes a substantially cylindrically shaped and elongated body which is horizontally recessed within a side of the door. A seating portion extends axially from the pin body beyond the door surface and in a direction towards the door jamb. The seating portion includes a straight edged portion and a sloping edged portion which terminates in the straight edged portion.

A receiving member is likewise horizontally recessed within an opposing portion of the door jamb and includes a pin receiving portion and an elongated and reduced diameter reinforcing portion extending axially from the pin receiving portion. The seating portion of the pin member seats within the pin receiving portion upon the door being rotated to a closed position and the reinforcing portion extends through one or more of the vertical wall studs of the wall structure proximate to the doorway. The strength of the wall structure is incorporated thereby into the restraining assembly to prevent a burglar from forcibly entering by kicking down the door.

The door restraining assembly according to one embodiment is incorporated into the hinge side of the door and door jamb and operates in combination with a traditional door latch mechanism on the opposing side. However, according to a preferred embodiment, an additional door restraining assembly is also provided on the latch side between the door and door jamb and is modified to replace a traditional latch mechanism. Specifically, the pin member of the additional restraining assembly is incorporated into the keyhole and door knob structure and may only be retracted from seating with the receiving member and reinforcing tube by rotating the door knob with the key in place. The seating portion on the hinge side pin member automatically seats within the receiving member upon the door being rotated to the closed position. The advantage of having restraining assemblies located on both sides of the door and door jamb is to make it all but impossible for a potential burglar to forcibly dislodge or kick down the door.

A method of installing a restraining assembly according to the present invention is also disclosed and claimed which includes the use of templates to position and guide a drill bit when forming the recesses within the door and jamb for accepting the pin member and receiving member. An additional disk shaped template is provided for inserting within the recess formed for accepting the pin receiving portion and provides a guide for drilling the hole for receiving the reduced diameter and axially extending reinforcing portion. Other additional steps of the method according to the present invention will be discussed in the following description of the preferred embodiments.

BRIEF DESCRIPTION OF THE DRAWING

A better understanding of the present invention will be had upon reference to the attached drawings, when read in combination with the following specification, wherein like reference numerals refer to like parts throughout the several views, and in which.

DESCRIPTION OF THE PREFERRED EMBODIMENTS

Figure 1:
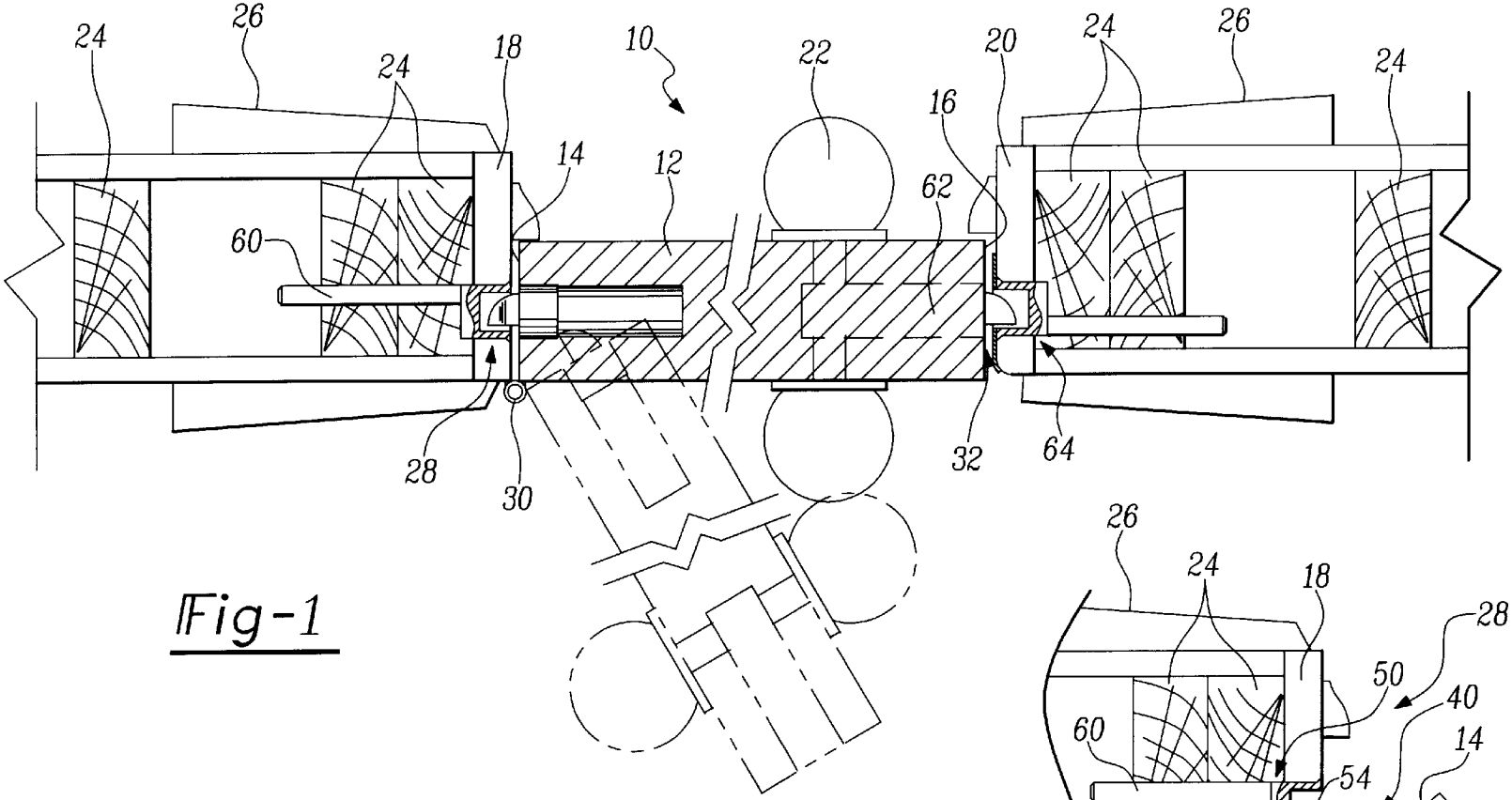
FIG. 1 is a top view in cutaway of a first restraining assembly located on a hinge side and a second restraining assembly located on a latch side for use with a door and surrounding door jamb according to a preferred embodiment of the present invention.

Referring now to FIG. 1, a restraining assembly 10 is shown for use with a door 12 hingedly connected to a surrounding door jamb which prevents the door from becoming forcibly dislodged from the jamb. The door 12 includes a hinge side 14 and a latch side 16 and the door jamb likewise includes a hinge side 18 and a latch side 20 which are in opposing fashion to the sides 14 and 16 of the door. The door 12 in FIG. 1 is illustrated in reduced width for ease of presentation, however as is visually apparent includes a top and a bottom and a door latch assembly 22, typically in the form of a doorknob, located in proximity to the latch side 16. A series of vertically extending wall studs 24 are positioned on opposite sides of the doorway and are each recessed within a wall structure 26. The wall studs 24 are customarily 2"×4" wood supports which form part of the wall frame and are generally considered to be the most durable part of the wall.

Figure 1A:
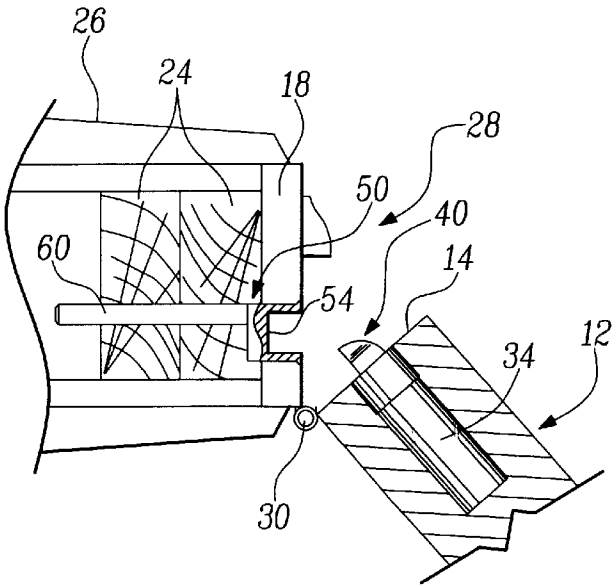
FIG. 1*a* is a view of the hinge side mounted restraining assembly as shown in FIG. 1 in which the door and hinge pin are in a partially rotated open position.

The restraining assembly 10 essentially includes a pin member mounted to extend from a side of the door 12 and a corresponding receiving member mounted within the door jamb in proximity to the pin member. In FIG. 1, and as is better illustrated in FIG. 1*a*, a first modification 28 of the restraining assembly is shown mounted in proximity to the hinge side of the doorway in proximity to a door hinge 30. As is also shown in FIG. 1, a second modification 32 of the restraining assembly is shown mounted in proximity to the latch side of the doorway. An explanation of the structure and operation of each modification of the restraining assembly will now be undertaken.

Figure 2:
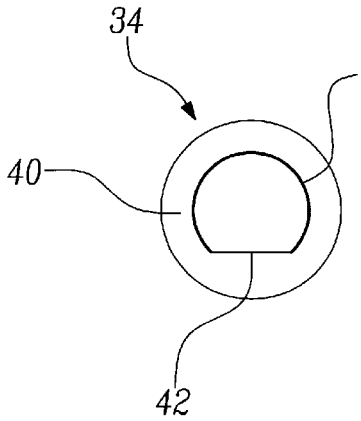
FIG. 2 is an end view of the pin member according to the present invention.
Figure 3:
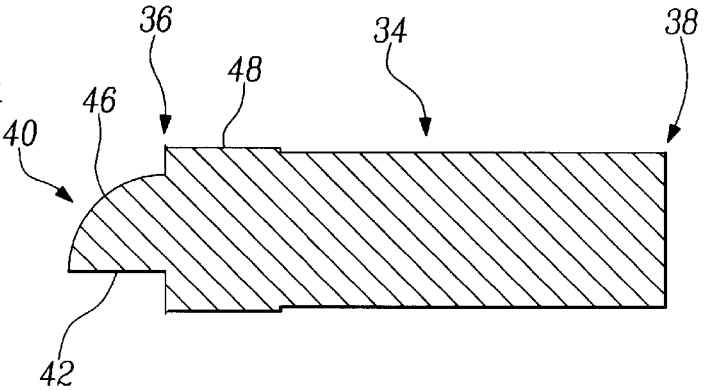
FIG. 3 is a side view in cutaway of the pin member according to the present invention.

Referring again to FIGS. 1 and 1*a*, and also to FIGS. 2 and 3, the first modification 28 of the restraining assembly includes a pin member 34 mounted within the hinge side 14 of the door 12. The pin member 34 is constructed of a solid brass alloy composite which is either produced by a forging or stamping process however the pin member 34 may also be made of any other suitable material such as a high impact resistant polymer or other material exhibiting the necessary properties of strength and durability. Referring specifically to FIG. 3, the pin member 34 has a substantially elongated and cylindrically shaped body with a front end 36 and a rear end 38 and a seating portion 40 which extends axially from the front end 36 of the body.

As is best shown in FIG. 2, the seating portion 40 in cross section includes a straight edged portion 42 and a circular shaped portion 44 which, when viewed again from FIG. 3, defines a sloping edge 46 which terminates in an arcuate shaped manner into the straight edged portion 42. A retaining lip portion 48, which is circular shaped in cross section, projects an outer lateral distance and extends a predetermined axial length along the pin member body in a sleeve-like manner. Preferably, the lip portion 48 extends from the front end 36 a short distance rearwardly along the pin body. The retaining lip portion 48 defines an extent of axial insertion of the pin member within the door face 14. As will be subsequently described in the method for installing the restraining assembly, an appropriately sized hole is formed in the door side(s) for receiving the pin member which is held in place by a tight friction fit created between the retaining lip portion and the circular wall of the hole.

Figure 4:
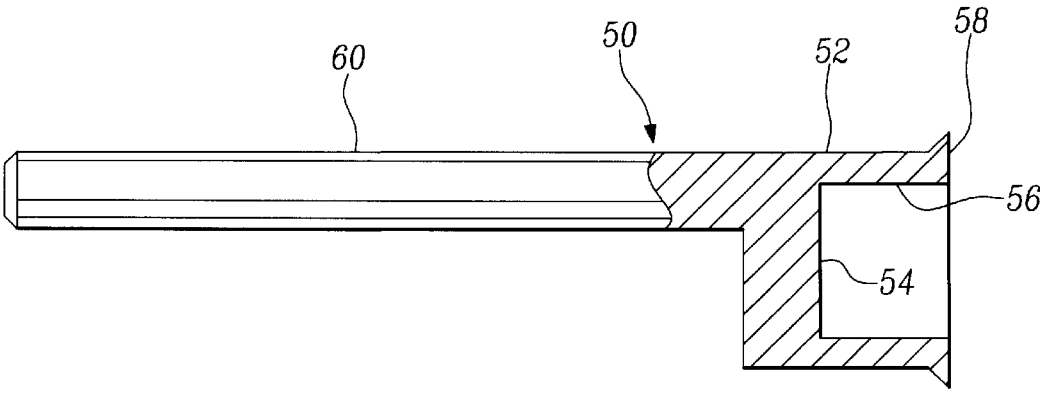
FIG. 4 is a side view, partially in cutaway, of the hinge side receiving member shown in FIGS. 1 and 1*a* according to the present invention.
Figure 5:
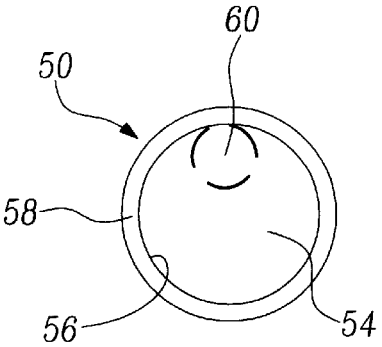
FIG. 5 is an end view of the receiving member shown in FIG. 4 and indicating in phantom the reduced diameter reinforcing tube portion extending from the pin receiving portion.

Referring again to FIGS. 1 and 1*a*, and also to FIGS. 4 and 5, a receiving member 50 according to the first modification 28 of the restraining assembly is shown. As with the pin member 34, the receiving member 50 may be constructed of a solid brass alloy or composite from an appropriate stamping or forging process but may also be constructed from any other material exhibiting the necessary properties of resiliency and durability.

Referring specifically to FIG. 4, a substantially cylindrically shaped member 52 has a hollowed interior defined by a bottom wall 54 and a continuous arcuate shaped side wall 56 and creates a portion within which the seating portion 40 of the pin member 36 is received as will be subsequently described. A rim plate portion 58 defines a circular shaped and projecting lip around the outer periphery of the cylindrically shaped member 52 and includes a flattened outer edge which is intended to lie flush against the surface of the door jamb 18 upon insertion of the receiving member 50 into the jamb 18 and to define an extent of insertion of the receiving member 50 within the wall structure 26.

The receiving member 50 includes a reinforcing portion 60 which is connected to and extends axially from the cylindrically shaped member 52 which defines the pin receiving portion. The reinforcing portion 60 is preferably a solid piece which is elongated in shape and has a reduced diameter relative to the pin receiving portion. As is shown in both FIGS. 1 and 1*a,* appropriately sized holes are drilled within the door jamb 18 and wall structure 26, as will be further described in the subsequent method for installing, for inserting the receiving member 50. The reinforcing portion 60 projects through one or more of the vertically extending wall studs upon insertion of the receiving member 50. The strength of the wall studs are thereby incorporated into the receiving member 50 to prevent the door from being forcibly dislodged from the door jamb.

Referring again to FIGS. 1 and 1*a,* the first modification 28 of the restraining assembly is shown in both a rotated opened and closed position. As is visually apparent, the rotation of the door 12 about the hinged axis 30 of the doorframe, as shown in phantom in FIG. 1, in combination with the sloping arcuate shape of the laterally projecting seating portion 40 enables the seating portion to automatically seat within the cylindrically shaped member 52 of the receiving member 50 when the door 12 is closed. Because the receiving member reinforcing portion 60 is recessed well into the wall structure 26 and through the wall studs 24, and not just partially recessed within the door jamb, the door 12 with projecting pin member 34 is able to withstand the force of an intruder attempting to kick down the door. In the instance of an outwardly opening door, an intruder would likewise be unsuccessful in obtaining entry by removing the hinges since the seating portion 40 of the pin member 34 would still be recessed within the receiving member 50.

Referring again to FIG. 1, the second modification 32 of the restraining assembly for use on a latch side of the door assembly includes a pin member 62 which is similar in most respects to the pin member 34 and is incorporated into a conventional door latch mechanism as represented by the door knob assembly 22. The pin member may also be provided as a standard latch member of a conventional door latch assembly having a setting portion which is operated by a retracting or projecting means. As such, the pin member 62 is not frictionally engaged within the door as in the modification 28, rather it is projected or retracted laterally from the door latch side 16 as desired by rotation of the door knob 22. The door latch mechanism may alternatively be provided in any other conventional form which is capable of selectively retracting or projecting the pin seating portion such as a deadbolt assembly or the like.

Figure 5A:
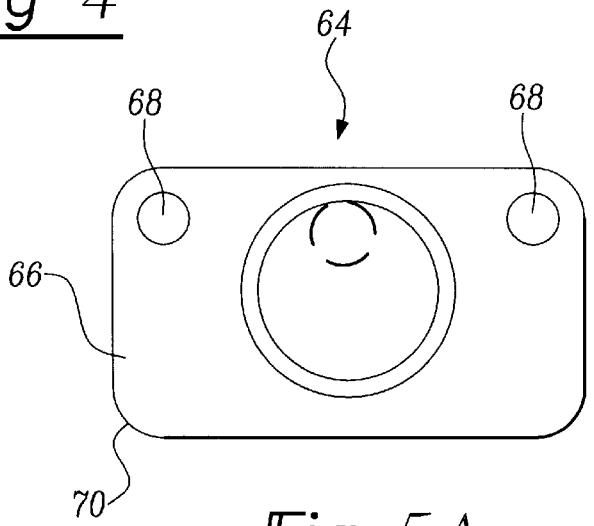
FIG. 5*a* is an end view of a latch side receiving member and illustrating in planar fashion the striker plate portion.
Figure 6:
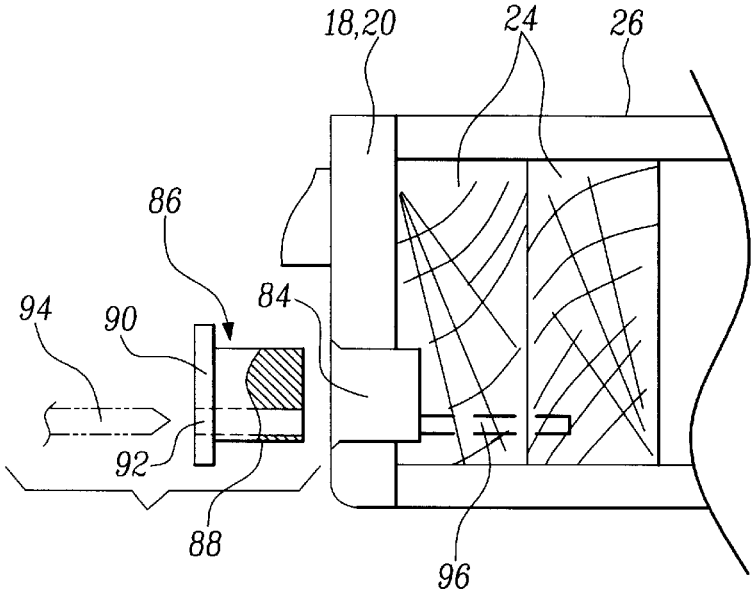
FIG. 6 illustrates a method step for installing the receiving member in which a drill forms a hole for the extending tube portion through a guide aperture in a template disk which is inserted into the pin receiving cavity prior to installing the receiving member according to the present invention.

A receiving member 64, identical in most respects to the receiving member 50 according to the first modification 28, is recessed within the latch side 20 and wall structure 26 in proximity to the opposing pin member 62. As is best seen in the end view of FIG. 5*a,* a striker plate portion 66 is mounted around a rim of the pin receiving portion and lies flush against the latch side 20 of the door jamb surface upon mounting of the receiving member 64. The striker plate portion 66 protects the latch side 20 surface of the door jamb in the event of the seating portion of the pin member 62 scraping along its edge and provides additional stability to the restraining assembly according to the second modification 32. A pair of mounting holes 68 are provided for receiving fasteners to mount the striker plate to the latch side 20 of the door jamb surface. As is also visually apparent from FIG. 1, a bottom edge of the striker plate 64 is curved, at 70, to conform to the edge of the latch side 20 towards which the door 12 rotates and this taper can also be seen upon review of FIG. 1.

In many instances, a single restraining assembly according to the modification 28 is sufficient for protecting the hinge side of the door and frame, assuming a latch locking assembly of satisfactory strength and durability is provided. However, according to a preferred embodiment, an additional restraining assembly according to the second modification 32 is provided on the latch side to increase the resistive capability of the door by also drawing upon the strength of the vertical wall studs on the latch side.

Figure 8:
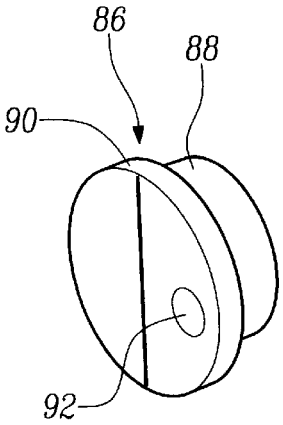
FIG. 8 is a perspective view of the disk-shaped template for gauging the depth of the pin receiving cavity and for drilling the reduced diameter tube portion of the receiving member as illustrated in FIG. 6.
Figure 9:
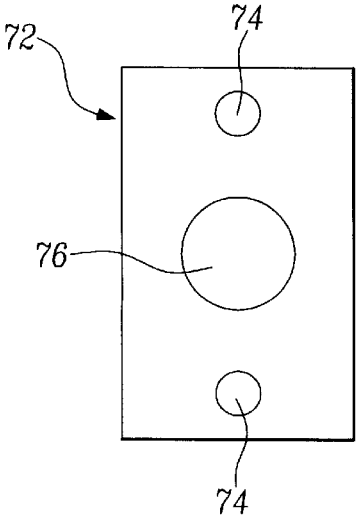
FIG. 9 is a view of a guide plate which is temporarily mounted in place of a conventional strike plate on a door surface for drilling a pin member hole.

Referring now to FIGS. 6–9, a method for installing a restraining assembly for use with a door hingedly connected to a door frame will now be described. Referring specifically to FIG. 9, a first template 72 is provided to create the appropriate hole for receiving the pin member 34, 62 according to either preferred modification of the present invention. Preferably, the template 72 is temporarily mounted over the hinge side 14 or latch side 16 of the door by fasteners which insert through apertures 74. Since the template 72 is used only as a guide for producing the pin member hole and not thereafter, it may preferably be constructed out of plastic or some other low cost material.

Once the template 72 is properly positioned on the desired door side surface, a drill (not shown) with an appropriate sized drill bit is positioned over a pin member recess 76 and drills a properly centered hole of a given diameter and depth within door. According to a preferred embodiment, a 1" diameter hole is drilled at a depth of between 3" and 3½" to accommodate the pin member. The template 72 is then removed and the pin member is inserted within the hole created in the door so that the seating portion projects in the desired fashion from the door side. Finally, a conventional striker plate (not shown) may be applied over the pin aperture and flush against the door jamb surface.

Figure 7:
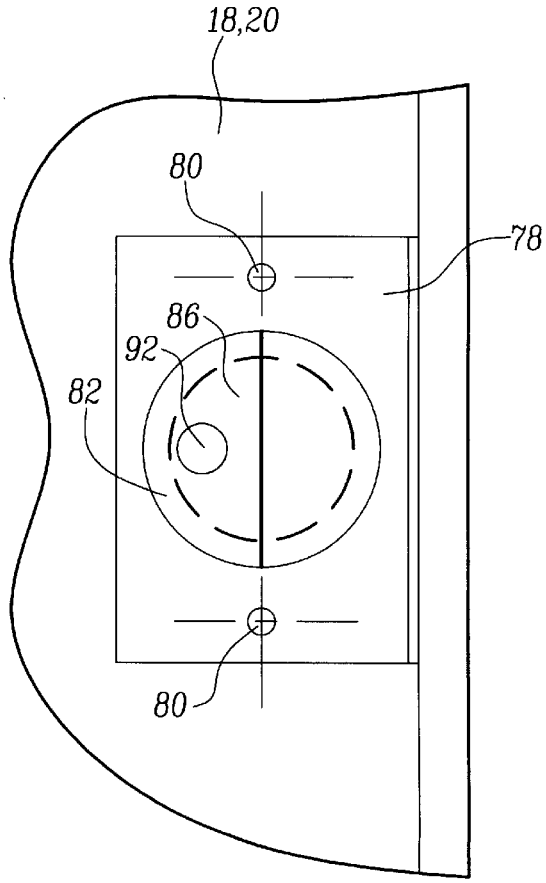
FIG. 7 illustrates a further method step for installing the receiving member in which a guide template is placed over a door knob side or hinge side of the door jamb in alignment with an opposing pin member for drilling the pin receiving cavity.

Referring again to FIGS. 6–8, the installation procedure for installing the receiving member 50, 64 to either the hinge side 18 or latch side 20 of the door jamb and according to either the first or second modifications will now be described. Referring specifically to FIG. 7, a second template 78 is placed over the door jamb surface 18 or 20 which corresponds to the positioning of the pin member with the laterally projecting seating portion. A pair of apertures 80 receive conventional fasteners for securing the second template 78 in place and the template 78 can either be temporary or permanent in nature as desired. A central aperture 82 is provided in the template 78 and is of sufficient diameter for receiving the seating portion of the pin member.

The drill is then used to drill a hole through the aperture 82 which, according to a preferred embodiment, is approximately 1" in diameter and 1" in depth. As is best seen from FIG. 6, an initial seating cavity 84 which is defined by a circular side wall and end wall is formed by the drill in either the door jamb 18 or 20 and may extend all the way through the jamb and partially through a first of the vertically extending wall studs 24.

Referring again to FIG. 6 and also to FIG. 8, a third disk shaped template portion 86 is inserted within the cavity 84. The disk shaped template portion 86 is shaped with a sleeve-like body portion 88 and a coin shaped cap portion 90 of increased diameter which extends from the body portion 88. A reduced diameter aperture 92 extends the entire axial distance of the disk shaped template portion 86 through the cap 90 and body 88. The aperture 92 is positioned within the disk portion so as to form a guide for receiving a further drill bit, indicated in FIG. 6 at 94. The aperture 92 is preferably capable of receiving a ⅜" drill bit and a further recess is drilled beyond the cavity 84 to a depth of at least an additional 3".

The disk shaped template portion 86 is then removed from within the door jamb revealing the initial recessed cavity 84 and a reduced diameter and axially extending recessed cavity 96 (see FIG. 6) which extends through one or more of the vertically extending wall studs of the wall structure. The reinforcing portion of the receiving member 50, 64 is inserted through the recess 96 until the cylindrical enclosure defining the pin receiving portion is seated within the cavity 84. The outer rim of the receiving member, such as defined by 58 in FIG. 4, may be tapped to lay flush in place against the surface of the door jamb. The method of installation as described herein can be used for installing a restraining assembly on either the hinge side, latch side or both of a door and surrounding door jamb.

The present invention therefore discloses a restraining assembly in which the resiliency of the studs of a wall structure is incorporated into a receiving member for seating a laterally projecting portion of a pin member mounted to a corresponding side of the door.

Having described my invention, additional embodiments will become apparent to those skilled in the art to which it pertains without deviating from the scope of the appended claims.

I claim:

1. A restraining kit assembly for use in combination with a door hingedly connected to a surrounding doorjamb, the door jamb being formed within a surrounding wall structure having a series of vertically extending wall studs, the door having a hinge side and a latch side, the door jamb likewise having a hinge side and a latch side and the door and jamb are positioned between the series of vertically extending wall studs of the wall structure, said kit assembly comprising:

a first template having a first aperture formed therein adapted for being secured at a desired location along said hinge side of the door, said first aperture adapted to permit drilling of a first hole within the door;

a first pin member having an elongate body and an axially extending seating portion, said body being adapted to be recess mounted within said first hole drilled within the hinge side of the door, said seating portion including a straight edged portion and a sloping edged portion which terminates in said straight edged portion, said seating portion adapted to project laterally from the door in a direction towards an associated hinge side of the door jamb;

a second template having a second aperture defined therein and adapted to be positioned at a desired location along said hinge side of the door jamb in an aligned and opposing relation to said pin member, said second aperture adapted to permit drilling of a second hole within the door jamb and said second hole corresponding to a circular recess;

a third disk shaped template having a third aperture defined therein and adapted to be inserted within said circular recess in the door jamb, said third aperture adapted to permit drilling of a third hole through one or more of the wall studs; and a first receiving member having a circular pin receiving portion and a reinforcing portion extending axially beyond said circular pin receiving portion, said circular recess receiving said circular pin receiving portion, said receiving member adapted to be recessed within the door jamb in proximity to said pin member so that said sloping edged portion of said seating portion clears said pin receiving portion and permits said seating portion to seat within said cavity of said pin receiving portion as the door is rotated to a closed position, said reinforcing portion adapted to extend past the door jamb in said hinge side and through said third hole in a substantially horizontal fashion through one or more of the vertical wall studs of the wall structure;

said restraining assembly adapted to incorporate the strength of the wall structure to prevent the door from being forcibly dislodged from the door jamb.

2. The restraining assembly according to claim 1, said elongate pin member body being substantially cylindrical in shape and having a front end and a rear end, said seating portion extending from said front end.

3. The restraining assembly according to claim 2, further comprising a retaining lip portion circular shaped in cross section which extends a predetermined axial length along said pin member body and which defines an extent of axial insertion of said pin member within said door.

4. The restraining assembly according to claim 1, said pin member and said receiving member extending in an opposed and horizontal fashion relative to one another and each being produced by a stamping process.

5. The restraining assembly according to claim 1, said reinforcing portion being elongated in shape and having a reduced diameter relative to said pin receiving portion.

6. The restraining assembly according to claim 1, said receiving member further comprising a rim plate secured about an outer periphery of said pin receiving portion, said rim plate being contoured to lay flush against a surface of said door jamb and to define the extent with which said receiving member is recessed within said jamb.

7. The restraining assembly according to claim 1, further comprising a second pin member of a second restraining assembly adapted to extend from said latch side of said door and being received within a second receiving member adapted to be recessed within said jamb on said latch side.

8. The restraining assembly according to claim 7, said second pin member forming a portion of a retractable door latch assembly, a second seating portion of said second pin member adapted for laterally translating out of said door to seat within a pin receiving portion of said second receiving member upon said door being rotated to said closed position.

9. The restraining assembly according to claim 8, said second receiving member further comprising a striker plate portion mounted to an outer rim of said pin receiving portion, said striker plate portion adapted to lay flush against a surface of the door jamb.

10. The restraining assembly according to claim 1, said pin member and said receiving member extending in an opposed and horizontal fashion relative to one another and each being constructed of a solid brass alloy composite.

* * * * *

UNITED STATES PATENT AND TRADEMARK OFFICE

CERTIFICATE OF CORRECTION

PATENT NO. : 5,769,473

DATED : June 23, 1998

INVENTOR(S) : Martin Sovis

It is certified that error appears in the above-identified patent and that said Letters Patent is hereby corrected as shown below:

Column 1, line 41, after "by" (first occurrence), delete --from--.

Column 1, line 57, before "Taft" delete --the--.

Column 6, line 32, before "door" insert --the--.

Column 7, line 16, delete "tapped" and insert --tapered--.

Column 7, line 33, change "doorjamb" to --door jamb--.

Signed and Sealed this

Ninth Day of February, 1999

*Attest:*

*Attesting Officer*

*Acting Commissioner of Patents and Trademarks*